US009989008B2

(12) United States Patent
Müller

(10) Patent No.: US 9,989,008 B2
(45) Date of Patent: Jun. 5, 2018

(54) ELONGATE COOLING CHANNEL INLET FOR COOLING CHANNEL PISTONS AND METHOD FOR OPERATING

(71) Applicant: KS Kolbenschmidt GmbH, Neckarsulm (DE)

(72) Inventor: Jochen Müller, Pfedelbach (DE)

(73) Assignee: KS Kolbenschmidt GmbH, Neckarsulm (DE)

( * ) Notice: Subject to any disclaimer, the term of this patent is extended or adjusted under 35 U.S.C. 154(b) by 78 days.

(21) Appl. No.: 15/302,768

(22) PCT Filed: Apr. 9, 2015

(86) PCT No.: PCT/EP2015/057771
§ 371 (c)(1),
(2) Date: Oct. 7, 2016

(87) PCT Pub. No.: WO2015/155309
PCT Pub. Date: Oct. 15, 2015

(65) Prior Publication Data

US 2017/0030291 A1 Feb. 2, 2017

(30) Foreign Application Priority Data

Apr. 9, 2014 (DE) ..... 10 2014 206 877

(51) Int. Cl.

| | |
|---|---|
| ***F02F 3/22*** | (2006.01) |
| ***F01P 7/14*** | (2006.01) |
| ***F02F 3/00*** | (2006.01) |
| ***F01P 3/10*** | (2006.01) |

(52) U.S. Cl.
CPC ..... *F02F 3/22* (2013.01); *F01P 3/10* (2013.01); *F01P 7/14* (2013.01); *F02F 3/003* (2013.01); *F02F 3/0015* (2013.01); *F02F 2003/0061* (2013.01)

(58) Field of Classification Search
CPC ..... F01P 3/06; F01P 2003/006; F01P 3/08; F01P 3/10
See application file for complete search history.

(56) References Cited

U.S. PATENT DOCUMENTS 4,548,127 A * 10/1985 Dunn ..... F02F 3/0023 123/193.6
4,614,150 A * 9/1986 Deutschmann ..... F02B 23/0603 92/221

(Continued)

FOREIGN PATENT DOCUMENTS

DE 1930302 A1 12/1970
DE 102011075300 A1 11/2012

(Continued)

*Primary Examiner* — Long T Tran
(74) *Attorney, Agent, or Firm* — Young Basile Hanlon & MacFarlance, P.C.

(57) ABSTRACT

The invention relates to a piston for an internal combustion engine, having a piston lower part, an upper part, an internal cooling channel having at least one coolant inlet opening and at least one outlet opening defined by a rim hole. The rim hole having a screw thread into which at least one tubular element is inserted and selectively positioned relative to the cooling channel for regulating the coolant level in a cooling channel.

17 Claims, 9 Drawing Sheets

(56) References Cited

U.S. PATENT DOCUMENTS

| | | | | |
|---|---|---|---|---|
| 7,409,903 | B2 * | 8/2008 | Scharp | F02F 3/22<br>92/186 |
| 7,603,977 | B2 * | 10/2009 | Heidrich | F02F 3/22<br>123/193.6 |
| 8,635,943 | B2 * | 1/2014 | Matsuo | F01L 3/24<br>92/181 R |
| 2011/0185992 | A1 * | 8/2011 | Gniesmer | B23P 15/10<br>123/41.39 |

FOREIGN PATENT DOCUMENTS

| | | | |
|---|---|---|---|
| JP | S56124650 | A | 9/1981 |
| WO | 2010009779 | A1 | 1/2010 |

* cited by examiner

ELONGATE COOLING CHANNEL INLET FOR COOLING CHANNEL PISTONS AND METHOD FOR OPERATING

TECHNICAL FIELD

The disclosure generally relates to the field of pistons for internal combustion engines.

BACKGROUND

Cooling channel pistons, in which a cooling channel (also known as cooling space) is arranged in the piston upper part (also known as piston crown), are known. The cooling channel generally has at least one opening into which a coolant is introduced. Once the latter has passed through the cooling channel, it leaves the cooling channel at a further opening or at the same opening.

DE 10 2011 007 285 A1 relates to a piston for an internal combustion engine, having a piston upper part and a piston lower part, an internal, preferably annular cooling channel for cooling the piston during operation of the internal combustion engine, and at least one inlet opening arranged on the piston lower part and at least one outlet opening arranged on the piston lower part, an inflow of coolant into the cooling channel and an outflow of coolant out of the latter taking place via said at least one inlet opening and at least one outlet opening, respectively, wherein the at least one inlet opening and/or the at least one outlet opening is/are surrounded by an annular bead or a ramp-like elevation which prevents a coolant level from dropping below predefined level, and which is formed integrally with the piston lower part. However, the annular bead can be created only at the level of the displaced material. Therefore, the possibility of influencing the level of the coolant in the cooling channel is also limited.

SUMMARY

The invention relates to a cooling channel piston for internal combustion engines and to a method for regulating the cooling level in the cooling channel.

Therefore, it is the object of the invention to be able to set the coolant level in a greater range and also to provide a method for setting the coolant level in the cooling channel.

This object is achieved by a piston and a method having the features in the independent claims.

The invention provides a piston, in particular for an internal combustion engine, having a piston lower part and a piston upper part, an internal, preferably annular cooling channel and at least one inlet opening arranged on the piston lower part and at least one outlet opening arranged on the piston lower part, an inflow of coolant into the cooling channel and an outflow of coolant out of the latter taking place via said at least one inlet opening and at least one outlet opening, respectively, wherein the at least one inlet opening and/or the at least one outlet opening is/are formed by a rim hole and the latter is formed integrally with the piston lower part, wherein the at least one rim hole has a thread into which at least one tubular element is inserted. As a result of the provision of a thread in at least one inlet opening and/or outlet opening, any desired elements through which coolant can flow can be screwed into the piston. As a result of the piston being manufactured with at least one thread, subsequent manufacture with regard to the coolant level in the cooling channel of the piston can take place. The pistons in question can be manufactured identically up to this step.

Furthermore, provision is made according to the invention for the at least one rim hole to terminate level with the surface of a cooling channel wall. As a result, the coolant level can be set freely via the length of engagement of a tubular element. Thus, there is no minimum filling level.

Alternatively, provision is made according to the invention for at least one rim hole to have at least one collar. As a result, the thread to be introduced there is reinforced. The connection between the piston and screwed-in component, for example a tubular element, becomes firmer.

Furthermore, provision is made according to the invention for the at least one collar to be formed on that side of the cooling channel wall that faces the pin bores. As a result, the at least one rim hole can be created in the piston assembled from the piston lower part and piston upper part.

Alternatively, provision is made according to the invention for the at least one collar to be formed on that side of the cooling channel wall that faces away from the pin bores and thus to project into the cooling channel. As a result, a minimum coolant filling level is achieved in the cooling channel.

Furthermore, provision is made according to the invention for the at least one tubular element to terminate flush with the at least one rim hole or with the collar of the at least one rim hole. In this case, the tubular element serves to supply coolant to the cooling channel better, but not to influence the coolant level in the cooling channel.

In a further configuration, provision is made according to the invention for the at least one tubular element to project into the cooling channel from the at least one rim hole and/or the collar of the at least one rim hole. As a result of the depth of penetration of the tubular element into the cooling channel, the level of the coolant in the cooling channel is influenced.

Furthermore, provision is made according to the invention for the at least one tubular element to project from the thread in the direction away from the cooling channel. In this case, the tubular element serves to supply coolant to the cooling channel better; for example, the coolant can be delivered directly into the tubular element with the aid of a nozzle.

Furthermore, provision is made according to the invention for that end of the at least one tubular element that is directed away from the cooling channel to be funnel-shaped. A funnel-shaped structure of the tubular element increases the collection of sprayed-in coolant from the nozzle. As a result of the funnel-shaped configuration of the tubular element, tolerances of the oil jet can be compensated. If the oil jet is fanned out, virtually the entire or preferably the entire volume flow can nevertheless be passed into the cooling channel between top and bottom dead center during the up and down movement of the piston.

According to the invention, a method is provided for regulating the coolant level in a cooling channel of a piston, in particular for internal combustion engines, which has at least one inlet opening and/or outlet opening in the cooling channel, formed by at least one rim hole, wherein the coolant level in the cooling channel is set via an adjustable tubular element.

Furthermore, provision is made according to the invention for the rim hole for forming the at least one inlet opening and/or outlet opening to have been created by friction drilling. Friction drilling does not produce any chips and is thus ideal for use in the production of pistons, since when the piston is used in an internal combustion engine, any chips would jeopardize operation of the internal combustion engine.

Furthermore, provision is made according to the invention for the thread in the rim hole, which forms the at least one inlet opening and/or outlet opening, to have been created by thread cutting. Thread cutting is a known and proven method in manufacturing. Therefore, thread cutting represents an alternative to thread forming.

Alternatively, provision is made according to the invention for the thread in the rim hole to have been created by thread forming. Thread forming is the ideal follow-on step to friction drilling, since, just like in friction drilling, no chips are produced in thread forming, either.

Furthermore, provision is made according to the invention for the cooling level to be regulated via the length of engagement of the tubular element in a thread located in the cooling channel. The length of engagement in this case denotes that length of the tubular element that projects into the cooling channel from the rim hole or the collar of the rim hole. By way of a thread, particularly precise regulation of the coolant level is possible. After the coolant level has been set, the tubular element can be secured in a force-fitting, form-fitting and/or material integral manner, in order that the setting of the coolant level is fixed during operation of the internal combustion engine.

The coolant level is regulated by the variation in the depth of engagement of the tubular element in the cooling channel.

Furthermore, provision is made for the tubular element to serve to transport coolant. Thus, coolant can be supplied to and/or drained from the cooling channel. Its design can be matched to the particular application.

A method is provided for regulating the coolant level in a cooling channel of a piston, in particular for internal combustion engines, wherein the coolant level in the cooling channel is set via an adjustable tubular element. By way of this method, a precisely defined quantity of coolant can be kept in the cooling channel of the piston during operation of the internal combustion engine.

The piston in question is also referred to as a cooling channel piston and can consist of at least two piston parts, for example a piston lower part and a piston upper part, which are assembled to form a piston by a force-fitting and/or form-fitting and/or materially integral joining method. Alternatively, the piston comprising the piston lower part and piston upper part can also be produced integrally in a production process, for example a casting method; in this case, the working step for joining the piston lower part and piston upper part is dispensed with. In order to create the cavities, grains of sand for example are used in a casting method, and after the casting process, these can be flushed out through openings provided separately for this purpose. These openings are closed after the flushing-out operation.

At the start of the friction drilling process, a relatively high axial force and rotational speed are required in order to create the necessary frictional heat between the friction drill and the cooling channel wall. In this case, the temperature of the friction drill rises very quickly to for example about 650° to 800° C., and that of the cooling channel wall rises for example locally to about 600° C.

The material that is displaced first out of the cooling channel wall initially flows upward counter to the feed direction, and with increasing depth of penetration, the actual rim hole is created in the feed direction. The ratio between material flowing upward and downward is for example about ⅓ to ⅔. This varies depending on the drilling diameter and the material thickness and can also be less (for example ¼ to ¾).

Once the friction drill has penetrated through the cooling channel wall, it then either forms the material that has flowed upward into a homogeneous collar or bead or directly removes this material again, depending on the type of friction drill. In this case, the geometric shape of the tool is reproduced in the material.

It has surprisingly been found that friction drilling (also known as flow drilling or form drilling) is an advantageous chipless method for producing rim holes in pistons, in particular in pistons for internal combustion engines. In this case, the material is not removed but displaced with the aid of force and frictional heat, thrown up in the form of a bead and formed into a type of bushing or rim hole in the piston, thereby avoiding the production of chips. The displaced piston material that has been thrown up in the form of a bead can be formed into a collar or removed. The stable bushings or rim holes that are produced are created by material displacement and not by removal of material. This homogeneous deformation not only effects additional material consolidation but also has a considerable time- and material-saving effect. The shape and diameter of the rim hole created in the piston are determined by the dimensions of the cylindrical part of the friction drill. On account of material displacement, no chips arise during the production of an opening in a piston. The displaced material is advantageously used to shape the region around the passage opening of the friction drill. As a result of the formation of a collar by the material thrown up in the form of the bead, the thread flight that is subsequently to be created can be extended. The stability with regard to the component, for example tubular element, accommodated in the thread is increased. In a screw-in connection, the screw-in depth has an influence on the stability of the connection between the accommodated piston and the screwed-in element, for example a tubular element. The risks of damage, cratering, thread deformation and/or thread shear are reduced by a screw-in depth increased by a collar on the rim hole in a piston. The screw-in depth is that length along which the component, for example a tubular element, that is received by the thread in the piston and the internal thread are actually in load-bearing engagement. A thread is provided to be fully load-bearing only in the range of the ideal screw-in depth. The terminal thread turns are not considered to be equivalent in terms of load-bearing capacity to the fully load-bearing thread turns located in between. Therefore, length deductions from the physically load-bearing screw-in depth are carried out, resulting in the ideal screw-in depth. In this way, a collar formed on the piston by friction drilling advantageously increases the number of the thread turns at the connection in the piston, for example the connection between the piston and a tubular element. The weakening of the load-bearing capacity at the thread runouts of internally threaded component and component received in the thread is referred to as end influences. As a result of the formation of the collar and the thread introduced into the latter, the end influences on the screw-in connection on the piston are at least compensated. Advantageously, the load-bearing capacity of the thread is increased by the formation of a collar at the rim hole in the piston, produced by friction drilling, compared with a conventional opening, produced for example by drilling or casting, in the piston.

The application of the friction drilling method to pistons results, in addition to the abovementioned advantages, in the following advantages, inter alia. As a result of the application of the friction drilling method in pistons, stable rim holes or bushings for receiving screw connections, such as tubular element through which coolant can flow, are produced. Furthermore, diagonal friction drilling is possible, in which case the central axis of the friction drilled hole or of the resulting rim hole deviates by an acute or obtuse angle from the vertical line formed by the piston stroke axis. Friction drilling is a chipless production method and connecting elements are not necessary. Friction drilling entails a large saving of time, work and material, since no additional components are necessary. The production of rim holes in pistons takes place in only one work operation. Friction drilling is a fully automatable method with minimal setup times. No rivet nuts or weld nuts are required for joining components, for example tubular elements. The friction drilling method affords greater reliability by homogeneous deformation and the service life of the piston is thus increased. Friction drills have long service lives and produced excellent surface qualities. No waste costs and disposal costs are incurred since the method is chipless. Furthermore, it is particularly advantageous that no chips jeopardize the operational reliability of the piston in the internal combustion engine. Thus, less failure of products can be noted. Friction drilling therefore affords high process reliability through durable carbide tools.

Friction drills are solid carbide tools having a polygonal contour. When pressed at a high rotational speed and axial force against thin-walled metal materials, they produce extreme frictional heat. As a result, the material of the cooling channel wall can be plasticized locally at the friction drilling position. The friction drill is guided through the cooling channel wall within a few seconds. As a result, without any loss of material whatsoever, a rim hole or a bushing is produced from the starting material. The length of this bushing can be for instance three to five times the original material thickness. The maximum material thickness to be machined is proportional to the core hole diameter of the friction drill. Depending on the core hole diameter, material with a thickness of between 0.5 mm (with optimum lining) and 12 mm (requires very high spindle power) is able to be machined. Depending on the material thickness and quality, it thus possible for 5000 to 10000 bores to be produced with a friction drill.

During thread forming, the advantages of friction drilling are pursued. Chipless bushing or rim-hole production effects strain hardening of the material to be machined and the cold rolled-in thread additionally reinforces the thread turns. For thread forming, any conventional thread cutting device can be used. However, care should be taken to carry out machining with a higher rotational speed (3 to 10 times the process speed). During thread forming, it is also possible to machine using a hand drill. The latter should in this case exhibit right-hand and left-hand rotation and sufficient power. Hand drill is the name given to handheld drilling machines. Depending on the construction type, they are suitable for friction drilling and/or thread forming in different materials such as metal or metal alloys of a piston. A common feature of all hand drills is the possibility of introducing friction drills and other rotating tools, for example thread formers, into a chuck fitted to the end side. The most important distinguishing feature of hand drills is the type of energy supply, which can occur manually by hand with the aid of muscular force, electrically, hydraulically or pneumatically. Such hand drills can preferably be used to produce small batches of pistons. Thus, any number of pistons that is desired by the customer can be produced with rim holes produced by friction drilling and threads produced by thread forming.

In what is known as threading, the thread former pushes the material of the rim hole or of the bushing into the thread flanks and, by chipless cold forming, effects compaction of the microstructure of the piston material. As a result, very high strength of the thread in the piston and exact thread guidance is achieved. As a result of the uninterrupted course of the piston material in the thread turns and the cold rolling of the thread forming process, a highly loadable connection has been created. On account of the exact thread guidance, there is no risk of miscutting.

The production of threads on pistons with the aid of the thread forming method has, inter alia, the following advantages. Thread forming is a chipless method and thus advantageously supplements the friction drilling method. Since no chips are produced in this production step, they cannot subsequently jeopardize the operation of the piston in an internal combustion engine. In thread forming, an increase in productivity is achieved by a higher process speed. The connection produced in the piston by thread forming is highly loadable and has exact thread guidance. As a result for example of a special TiN coating, an increase in service life can be achieved. Furthermore, the length and wall thickness of the rim hole produced in the friction drilling method are fully retained. The thread forming method, too, is a fully automatable method. Existing production facilities can be used, since the thread forming method is employable on all conventional thread cutting devices.

In contrast to conventional thread cutting, thread forming in conjunction with friction drilling has enormous advantages. The previous warm displacement of the material during friction drilling and the subsequent cold rolling during thread forming effect strong consolidation of the material of the cooling channel wall. This ensures highly pull-out resistant threaded connections. The chiplessly operating thread former brings about a considerable increase in productivity on account of the very high cutting rate and extremely long service life.

The opening to which the coolant is fed is oriented in the direction of a cooling oil nozzle, wherein the coolant is sprayed out of the cooling oil nozzle in the direction of the opening. In this case, care should be taken during the fitting of the cooling channel piston in the cylinder of the internal combustion engine and also during operation to ensure that the cooling oil jet leaving the cooling oil nozzle during the oscillating up and down movement of the piston in the cylinder chamber strikes precisely the opening on the underside of the piston inner region in order that the cooling oil can pass into the cooling channel.

The cooling channel is realized for example in a manner known per se with the aid of a lost core during the casting of the cooling channel piston, wherein at least one opening, for example a bore, is introduced from the piston inner region after the casting process, in order to reach the lost core and flush it out.

In addition to this embodiment, it is known that an extended inflow is realized as an additional bore in the actual piston. In this case, a thickening is generally cast or formed in the piston main body in the region of the piston hub, wherein this thickening is subsequently drilled out.

This extended inflow opening from the piston inner side in the direction of the cooling channel has the advantage that the coolant sprayed or introduced into this inflow can be guided better and deflected in a more targeted manner into the cooling channel and circulate therein.

The invention is based on a cooling channel piston in which, following the production of the cooling channel piston in any desired manner, a cooling channel (or a plurality of cooling channels all portions of the like) is provided in the piston crown, wherein the at least one opening for the inflow of the coolant is located approximately beneath the plane in which the piston crown ends as viewed toward the bottom (that is to say above the pin bore or the crown of the pin). Such a piston, which forms the basis of the invention, thus does not have a thickening at the piston hub, which is cast and formed and subsequently drilled out.

Proceeding from the at least one opening for the inflow (or outflow) of the coolant approximately beneath the plane of the axial end of the piston crown, a component is arranged at the inflow opening, said component forming an extended cooling channel inflow (or an extended cooling channel outflow). This component is in one piece or can also be produced from several components. The at least one component consists for example of a steel material (e.g. sheet metal), plastics material, a composite material or a light metal material and can be produced cost-effectively for example in the form of a widening or narrowing tubular component or tubular element. The attachment can take place by a simple attachment method such as screwing, adhesive bonding, stitching, form-fitting, clip-fastening, soldering, welding, shrink-fitting or pressing or the like.

The component can be embodied such that it projects into the interior of the cooling channel inflow, in other words beyond the plane in which the inflow or outflow opening is located. The resulting shoulder that projects into the cooling channel advantageously prevents a backflow of coolant in the direction of the component. This ensures that, during the oscillating up and down movement of the piston in the cylinder of the internal combustion engine, a certain quantity of coolant always remains in the cooling channel. This can absorb heat from the surrounding regions of the piston crown and is mixed with inflowing fresh coolant by the shaker action and as a result can dissipate heat in an improved manner.

As a result of the extended cooling channel inflow by the supplementation of the cooling channel with the at least one component according to the invention, the filling of the cooling channel piston with coolant can be considerably improved especially at bottom dead center. Measurements have in this case revealed an improvement of 60% not only for filling but also for heat dissipation.

Furthermore, there is a reduction in weight when thickened regions, into which a bore would need to be introduced for the purpose of an extended cooling channel inflow, do not have to be provided next to the piston hub. As a result, the attachment of the piston skirt of the cooling channel piston to its hub is more convenient.

Furthermore, it is conceivable to equip any desired pistons which have a cooling channel, wherein the cooling channel itself has at least one outflow and/or inflow opening, with an extended cooling channel inflow or outflow according to the invention.

This invention is intended to realize an extended cooling channel inflow by way of one or more additional components on the piston. The extended cooling channel inflow is intended to be provided as (an) additional component(s) for pistons for an internal combustion engine, for example as a tubular element.

The invention makes it possible to considerably improve the filling of the cooling channel. More cost-effective production is possible.

An extended inflow has hitherto been realized as an additional bore in the actual piston. A thickening is cast or formed in the piston material at the piston hub and is subsequently drilled out. This has been state of the art for many years in the case of aluminum pistons; in this case the bore can be cast.

As a result of the extended cooling channel inflow, the filling of the cooling channel in the piston with cooling oil can be considerably improved especially at bottom dead center. Measurements show an improvement of up to 60%.

The invention achieves more cost-effective production of the extended cooling channel inflow, especially in pistons which are not cast. With such a solution, the attachment of the piston skirt to the hub is more cost-effective, since no material has to be provided to be subsequently drilled out. A reduction in the piston weight or the mass of the piston is possible. However, in the prior art, the piston is embodied with the conventional design, that is to say the thickening is forged on and subsequently the extended inflow is drilled out.

It is also possible to produce a relatively short collar, with regard to the passage length of the inlet opening and/or outlet opening, by friction drilling. In this case, the cooling action is primarily improved in that a collar is produced in the cooling channel, said cooling channel preventing backflow of the cooling oil. For extension, a small tube, for example a tubular element, can be screwed in.

This method also has the advantage that a bore is created without chips being produced. Friction drilling can therefore replace the currently very complicated opening using an ECM method. Electrochemical machining (ECM) is a material-removing manufacturing method in particular for very hard materials, belonging to the cutting group of methods. ECM is suitable for simple deburring work all the way through to the production of openings in pistons.

In the case of a rim hole having a collar or surrounded by an annular bead or a ramp-like elevation, the coolant level can be prevented from dropping below a predefined level. This at least one rim hole is implemented in the cooling channel wall facing the pin bores.

BRIEF DESCRIPTION OF THE DRAWINGS

Further configurations of the invention are specified herein which further advantages can be gathered. Exemplary embodiments of the invention are described in the following text and shown in the figures, in which.

DETAILED DESCRIPTION

In the following description of the figures, terms such as top, bottom, left, right, front, rear etc. relate exclusively to the exemplary illustration and position, selected in the respective figures, of the device and other elements. These term should not be understood as being limiting; in other words, these references can change as a result of different positions and/or a mirror-symmetrical construction.

FIGS. 1A, 1B, 2, 3A, 3B, 4, 5, 6 and 7 show a piston 1 or components of the piston 1 in the form of a piston lower part 2 and/or of a piston upper part 3. The following description of the figures deals with the common features of the piston 1 in question.

Figure 2:
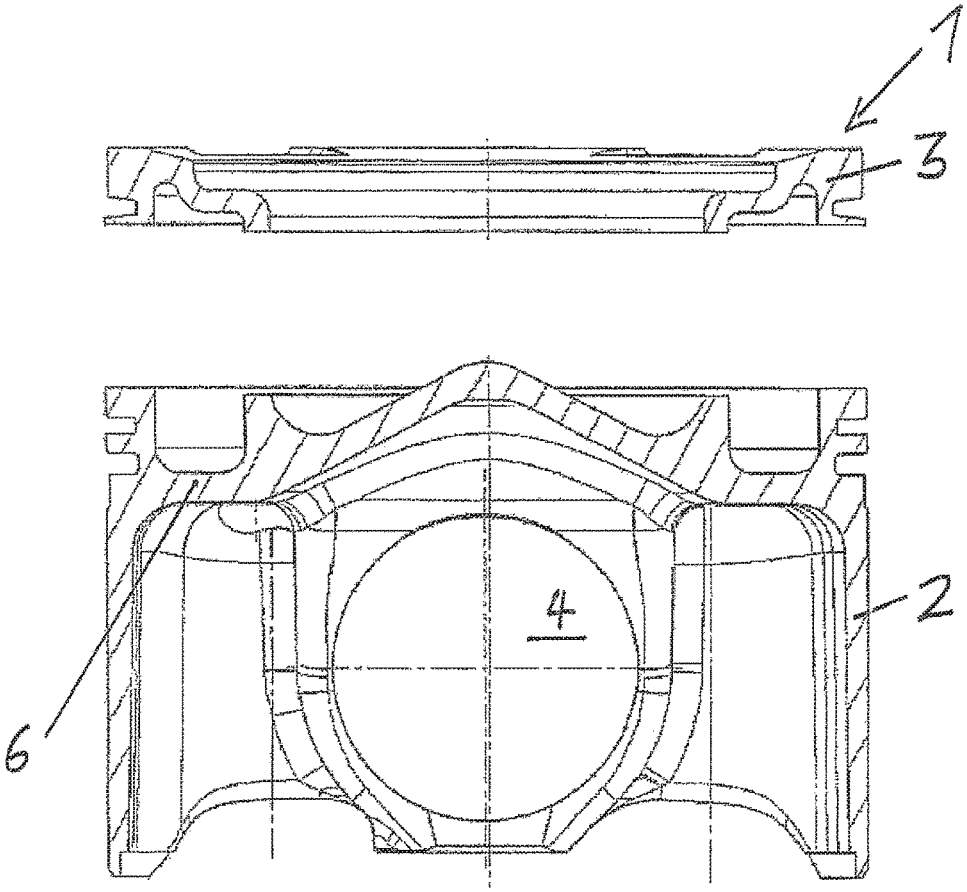
FIGS. 2 shows sectional views of the piston upper part and piston lower part before they are joined to form a piston.

The piston lower part 2 has at least one pin bore 4. Furthermore, the piston 1 has a radially encircling cooling channel 5 behind a ring zone 7 that is not shown in more detail. This cooling channel 5 is bounded in the direction of the pin bores 4 by a cooling channel wall 6. The piston upper part 3 has a combustion bowl 8. The combustion bowl 8 can be present, but does not have to be. During operation of the piston 1 in an internal combustion engine, the piston 1 moves in the direction of a piston stroke axis 9. The piston lower part 2 and the piston upper part 3 are joined to form a piston 1 by way of a materially integral connection. An appropriate method for materially integral joining is welding, in particular friction welding. During welding, an external joining seam 16 and an internal joining seam 17 are produced. FIG. 2 shows the piston lower part 2 before the piston 1 is assembled and FIG. 2 shows the piston upper part 3 before the piston 1 is assembled.

The cooling channel wall 6 has at least one rim hole 12. This rim hole 12 is provided with a collar 13 (see FIGS. 1A, 1B, 3A, 3B, 6 and 7). The at least one rim hole 12 serves as at least one inlet opening and/or the at least one outlet opening for coolant. The at least one rim hole 12 is provided with a thread 14. A straight tubular element 15 (having the same diameter) or a tubular element 115 that is widened on at least one side (in a funnel-shaped manner, having a diameter that varies at least in subregions) can be introduced into this thread 14. Coolant flows into and/or out of the cooling channel 5 via these tubular elements 15, 115. The level of the coolant in the cooling channel 5 can be set by the length of engagement of these tubular elements 15, 115. X indicates the distance between the cooling channel wall 6 and the opening located at the end of the tubular elements 15, 115. Y denotes the distance between the collar 13 and the opening located at the end of the tubular elements 15, 115. The level of the coolant in the cooling channel 5 is set using the smallest value of X. If several tubular elements 15, 115 have been installed, the tubular element 15, 115 that projects into the cooling channel 5 with the smallest free length thus determines the level of the coolant in the cooling channel 5. If the inlet opening 10 is located higher up than the outlet opening 11, a continuous coolant flow is established between the inlet opening 10 and the outlet opening 11. The level of the coolant in the cooling channel 5 is determined by the position of the outlet opening 11 in the cooling channel 5. The end-side opening, located in the cooling channel 5, of the tubular elements 15, 115 can thus act as the inlet opening 10 and/or outlet opening 11. At the outer circumference, the tubular elements 15, 115 have a thread at least in one subregion. This thread is executed such that it can be screwed into the thread 14. Depending on the thread structure, very precise adjustment of the inlet opening 10 and/or outlet opening 11 in the cooling channel 5 is allowed. Thus, the coolant level in the cooling channel 5 of the piston 1 can be set precisely for subsequent use. It allows a piston 1 having different coolant levels to be marketed. Furthermore, a tubular element 15 with a straight design or alternatively a tubular element 115 that is widened on at least one side can be installed. The piston 1 is therefore variable in terms of the coolant quantity provided during operation in an internal combustion engine. Depending on the piston, it is also possible for only one tubular element 15, 115 to be used. The tubular element 115 that is widened on at least one side is suitable in particular for collecting a coolant jet sprayed through nozzles.

Figure 1A:
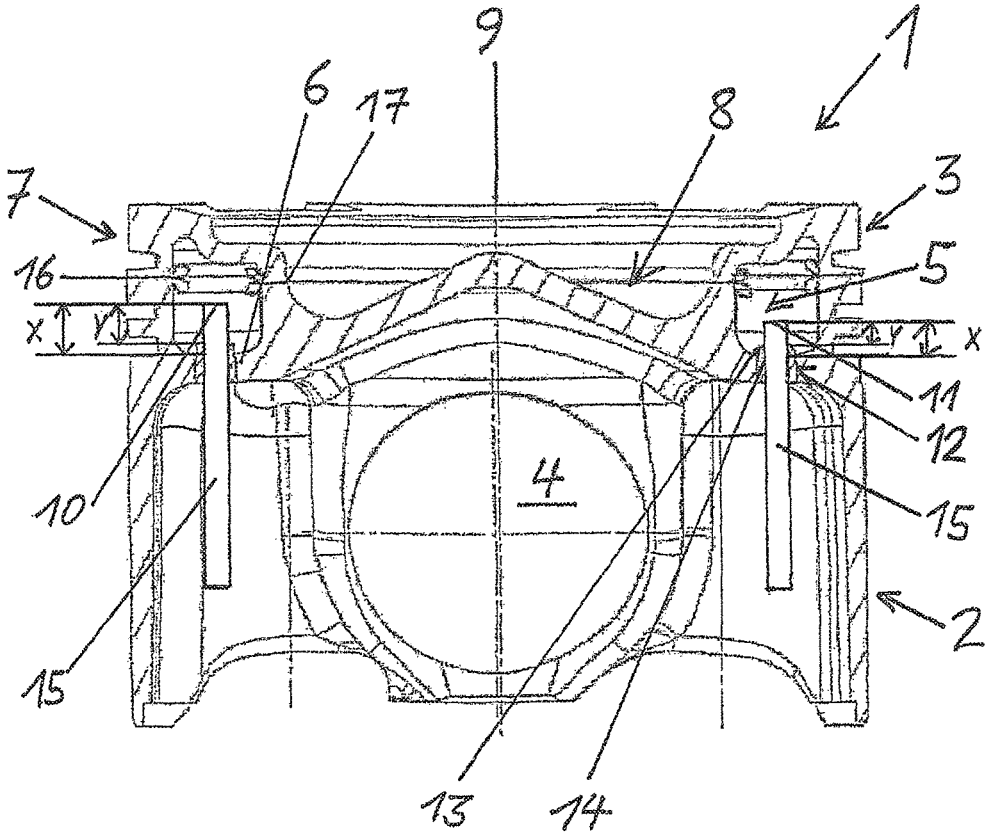
FIGS. 1A and 1B each show a sectional view of a piston according to the invention transversely to the pin axi.
Figure 1B:
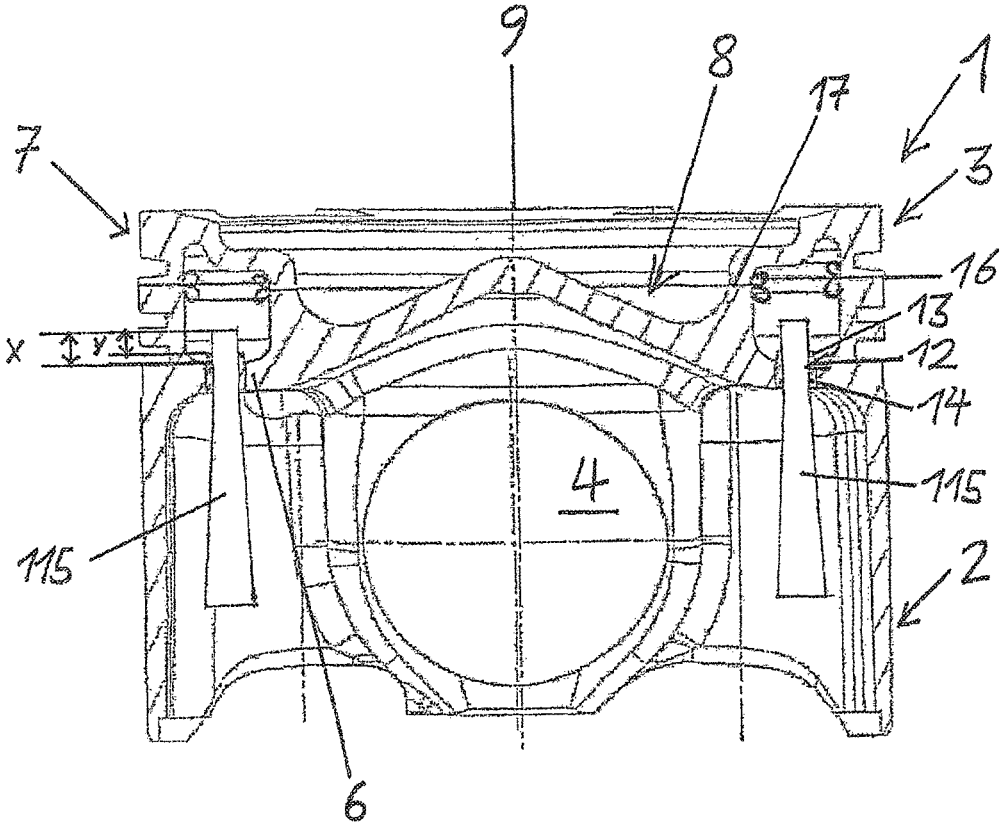

FIG. 1A shows the piston 1 with two tubular elements 15. FIG. 1B shows a piston 1 having a tubular element 115 that is widened on at least one side. Following the adjustment of the tubular elements 15, 115, these can be fixed in a force-fitting, form-fitting or materially integral manner. Fixing can take place for example at the rim hole 12 or at the cooling channel wall 6.

Figure 3A:
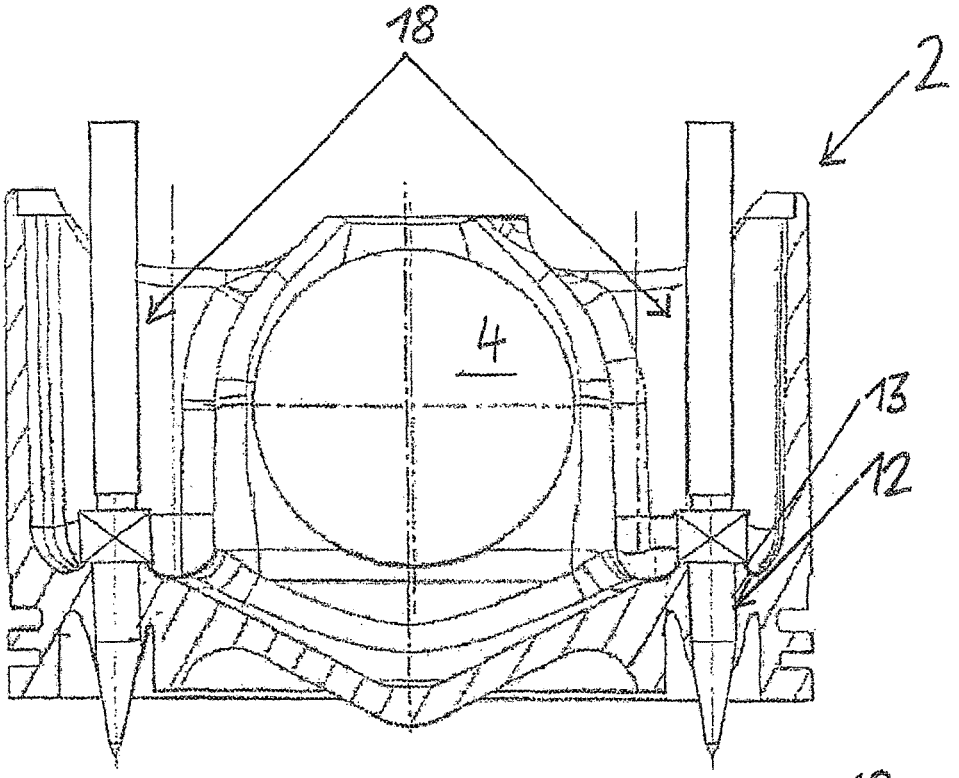
FIGS. 3A and 3B each show a sectional view of the piston lower part from FIG. 2B during machining.
Figure 3B:
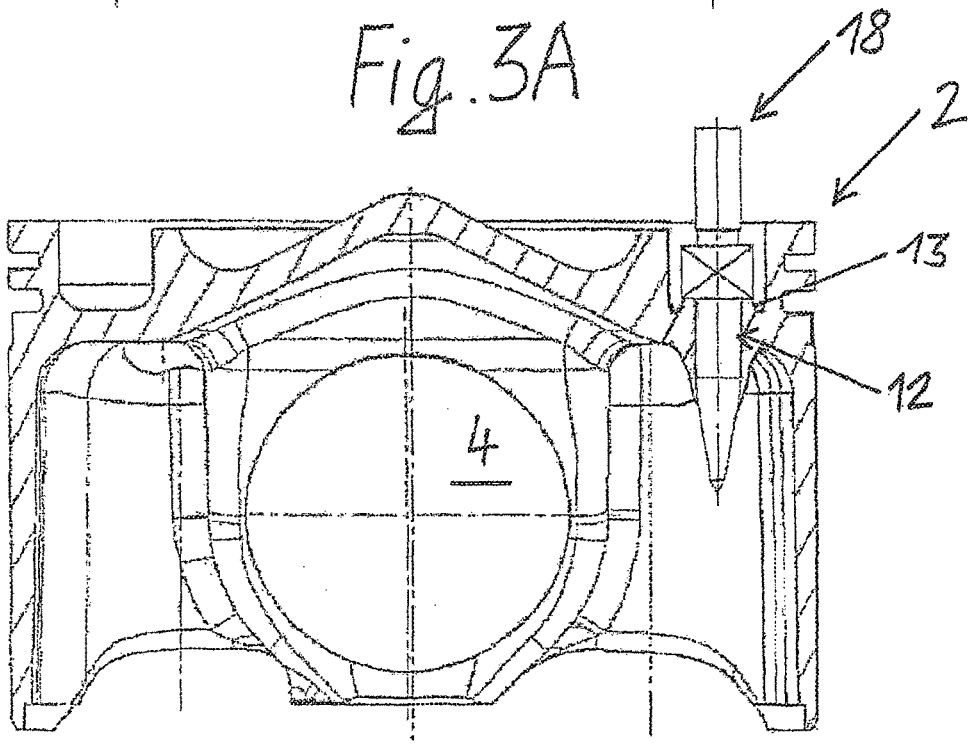

FIGS. 3A and 3B show a piston lower part 2 during the production of a rim hole 12 in the region of the cooling channel wall 6 with the aid of a friction drill 18. The rim hole 12 is virtually complete here, since the collar 13 has already been fully formed.

Figure 4:
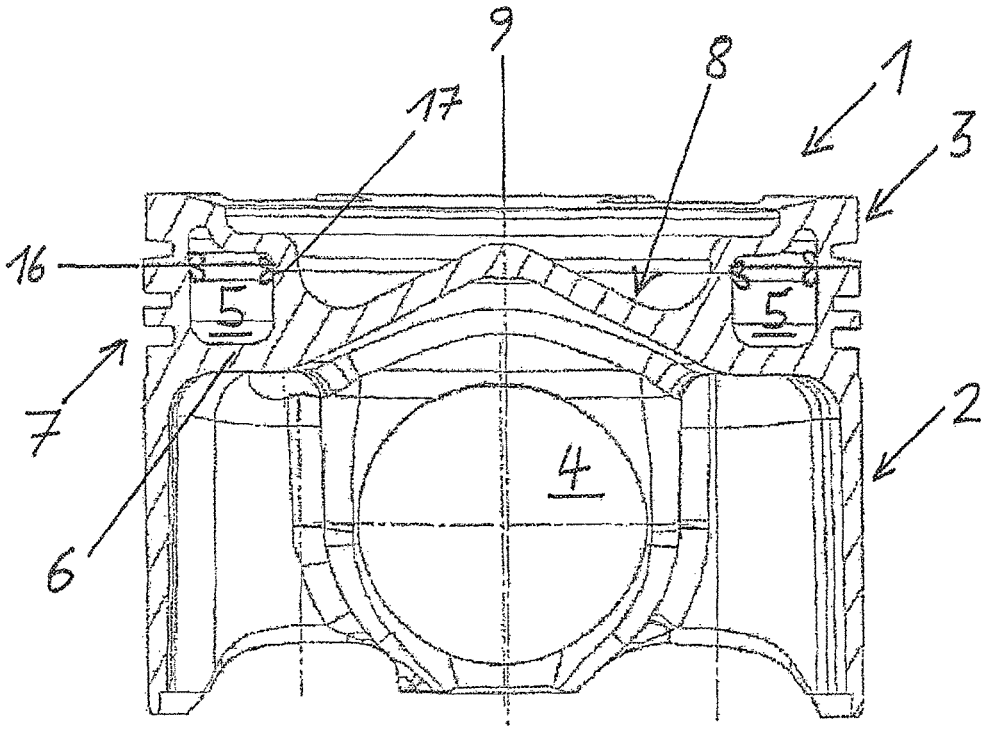
FIG. 4 shows a sectional view of a piston assembled from the piston upper part and piston lower part according to FIGS. 2.

FIG. 4 shows the piston 1 according to FIGS. 2 (piston upper part 3) (piston lower part 2) after a materially integral joining method, in particular a friction welding method, has been carried out. Weld beads have been formed at the joining seams 16, 17.

Figure 5:
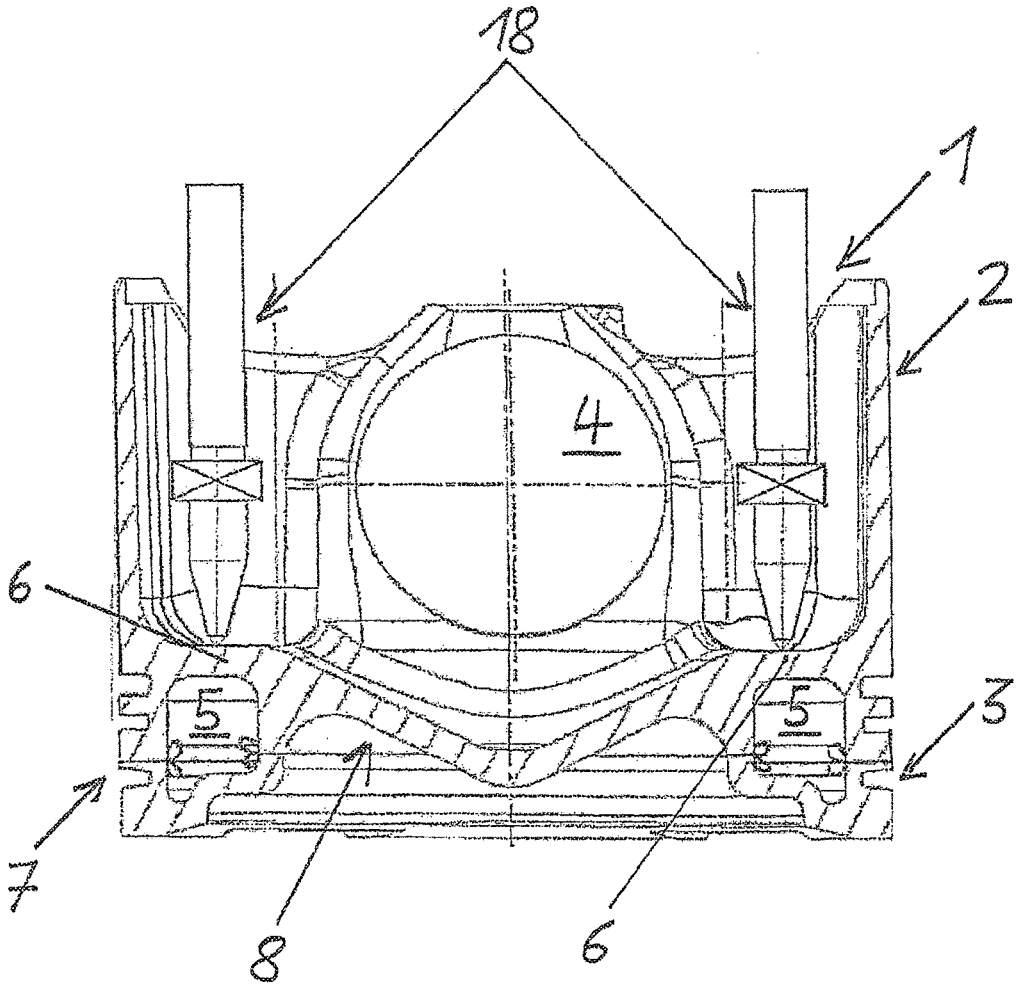
FIG. 5 shows a sectional view of a piston according to FIG. 4 during machining.

FIG. 5 shows a piston 1 assembled from the piston lower part 2 and piston upper part 3 during the action of friction drills 18 on the cooling channel wall 6. The friction drilling method can be applied to the piston lower part 2 before joining (see FIGS. 3A and 3B) or after joining (see FIG. 5). After joining or machining of the cooling channel wall from the direction of the pin bores 4, the collar 13 is produced on that side of the cooling channel wall 6 that faces the pin bores (see FIGS. 3A and 5). As a result of the subsequent forming of a thread 14 (see FIGS. 5 and 6) or the forming of a thread 14 from the direction of the pin bores 4 (see FIGS. 3A and 6) into the rim hole 12, it is not necessary for a collar to be produced within the cooling channel 5; as a result of the tubular element 15, 115, the level of the coolant in the cooling channel 5 can be set freely. The collar 13 develops its thread-extending action and thus also its connection-reinforcing action regardless of whether it is arranged on that side of the cooling channel wall 6 that faces the pin bores 4 or is arranged on that side of the cooling channel 6 that faces away from the pin bores 4. Thus, the machining of the cooling channel wall 6 can take place by friction drilling and subsequent thread forming can also take place on the piston lower part 10 and piston upper part 11. Alternatively, the combination of friction drilling and thread forming can be carried out on a piston cast or forged in one piece.

Figure 6:
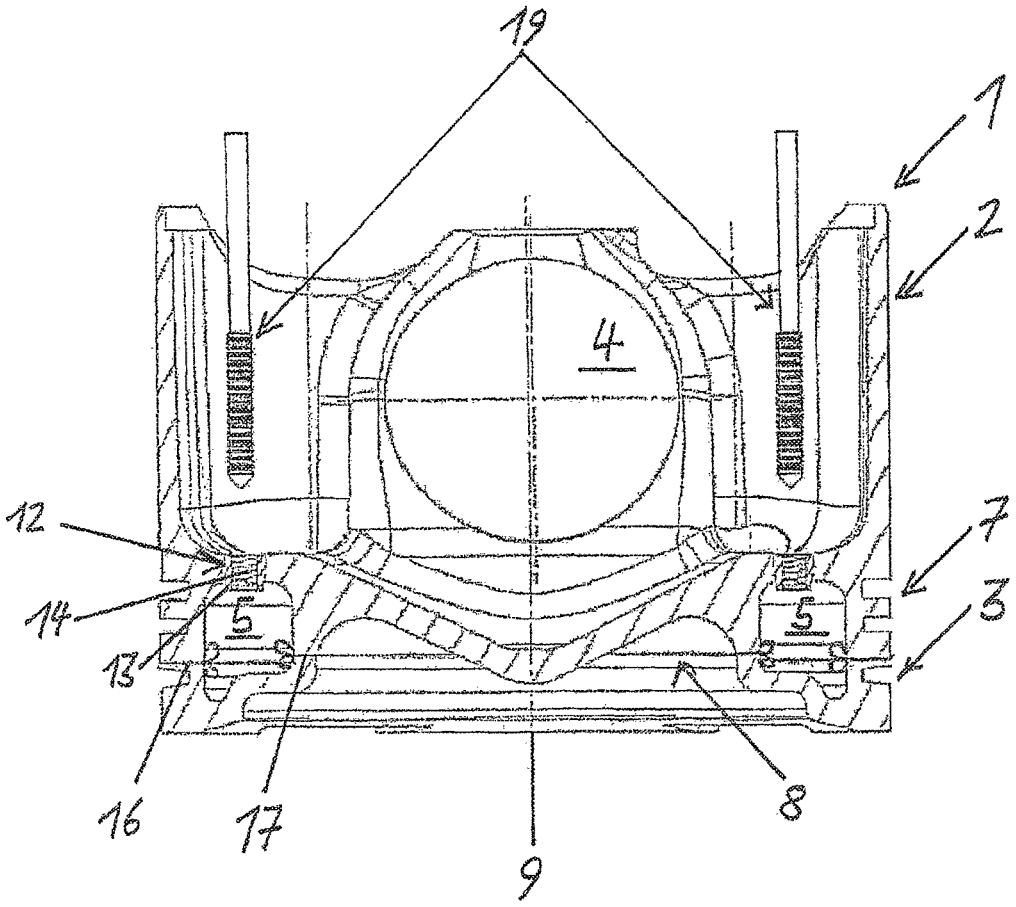
FIG. 6 shows a sectional view of a piston according to FIG. 5 during thread forming.

FIG. 6 schematically shows the production of the thread 14 in the rim hole 12 by way of a thread forming method. A thread former 19 for producing the thread 14 acts on the rim hole 12, previously produced by friction drilling, in the cooling channel wall 6.

FIGS. 1A, 1B, 3A, 5, 6 and 7 show the parallel production of two rim holes 12 or two threads 14; it should be noted, however, that it is also possible for only one rim hole 12 or one thread 14 to be produced, as illustrated in FIG. 3B. It is also possible for more than two rim holes 12 with threads 14 to be formed on the piston 1, for example on a cooling channel wall 6 of the cooling channel 5. It is also possible for a central cooling chamber (not illustrated here) to be provided with at least one rim hole and at least one thread.

Figure 7:
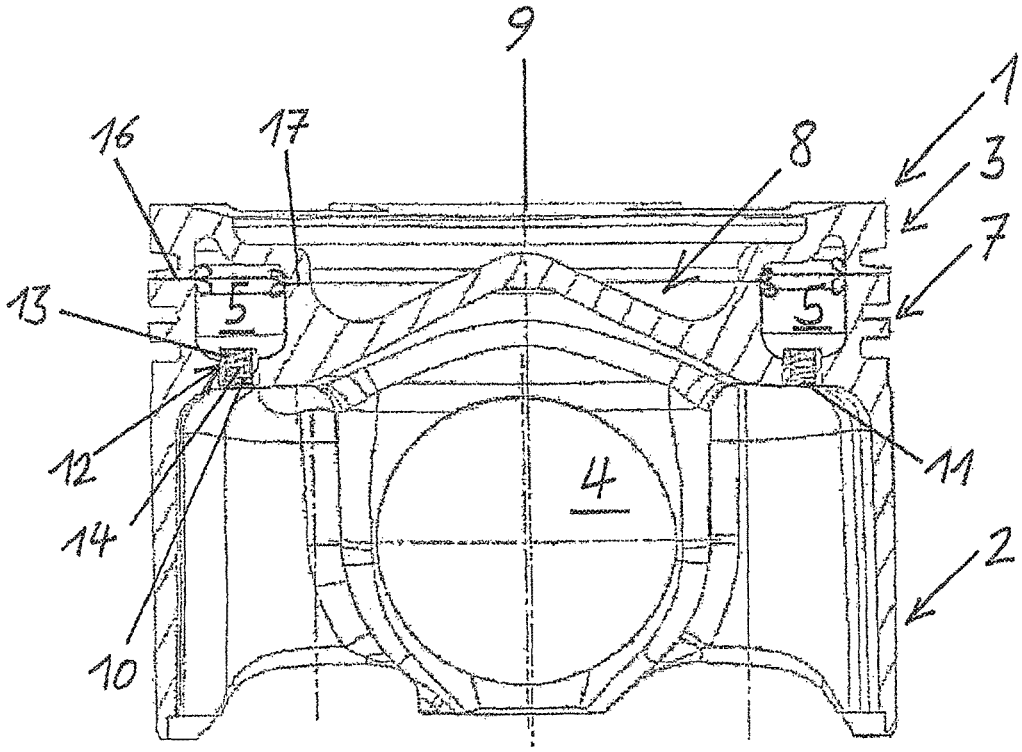
FIG. 7 shows a sectional view of a piston according to FIG. 6 after the thread has been completed.

FIG. 7 shows a piston 1 after the production of rim holes 12 with threads 14.

The friction drilling process illustrated schematically in FIGS. 8A to 8G comprises the following steps.

Figure 8:
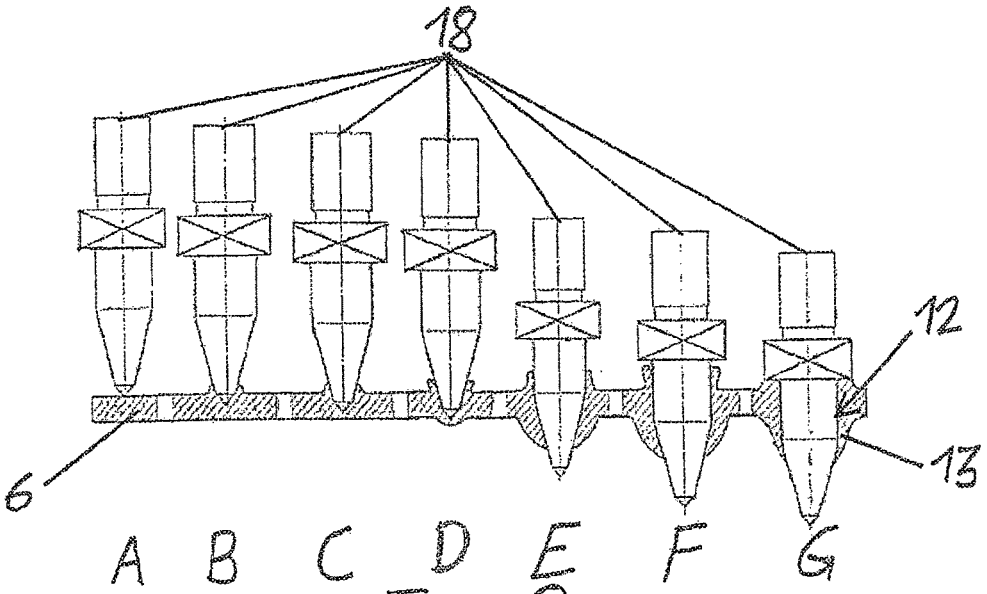
FIGS. 8 schematically shows the machining steps A through G during the friction drilling of a piston.
Figure 9:
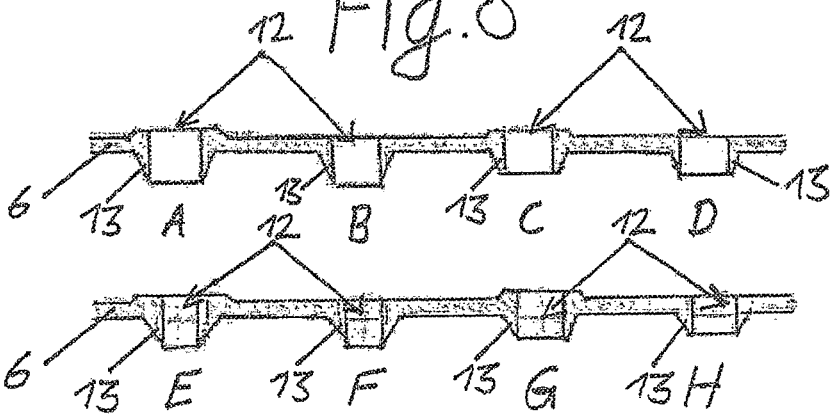
FIGS. 9 shows the configurations A through H of friction drilled holes in pistons.

The first step, illustrated in FIG. 8A, contains the placing of the top of the friction drill 18 on the cooling channel wall 6.

FIGS. 8B and 8C show preheating. To this end, the friction drill 18 is pressed with high axial force and rotational speed against the cooling channel wall 6, with the result that the necessary frictional heat is generated and the material thereof is heated up. The friction drill 18 can then penetrate into the material and form the rim hole 12.

The third step is illustrated in FIGS. 8D to 8F and comprises the forming operation. The friction drill 18 initially displaces the material of the cooling channel wall 6 upward counter to the feed direction. With increasing depth of penetration, the rim hole 12 is then produced in the feed direction. The ratio between the material flowing upward and the material flowing downward is about ⅓ to ⅔.

FIG. 8G shows the fourth step, shaping. The friction-formed rim hole 12 is finished. Depending on the friction drill 18, the material of the cooling channel wall 6 that flowed upward is formed into a homogeneous collar 13 or bead. In the tools trade, the friction drills required for this purpose are usually designated as the "forming" or "standard" type. Alternatively, the material of the cooling channel wall 6 that flowed upward was directly removed again. In the tools trade, the friction drills required for removal are usually designated as the "cutting" or "flat" type. If the collar 13 has been removed or virtually removed, a tubular element 15, 115 can nevertheless be advantageously provided in the thread 14 formed in the rim hole 12. It is also possible for two tubular elements 15, 115 to be introduced into a thread 14, wherein they preferably butt against one another within the thread turns.

The collar 13 is formed depending on the tool type, for example as a rim in the form of a sealing ring or as a planar surface. FIGS. 9A to 9H show configurations of rim holes 12 with collars 13, produced by different tool types.

Figure 10:
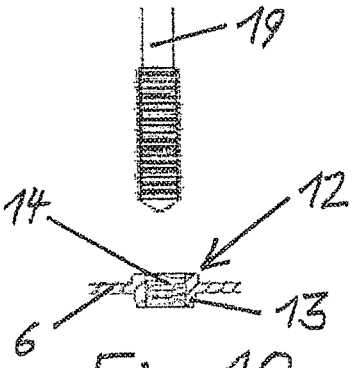
FIG. 10 schematically shows the production of a thread.

FIG. 10 schematically shows the production of the thread 14 by thread forming. The process sequence during thread forming is as follows.

The production of the thread 14 by thread forming is referred to as threading; in this case, the thread former 19 pushes the material of the rim hole 12 into the thread flanks and effects compaction of the microstructure by way of chipless cold forming. As a result, very high strength of the thread 14 and an exact thread guidance are achieved. As a result, on account of the uninterrupted course of the material in the thread turns and the cold rolling of the thread forming process, a highly loadable connection has been produced. On account of the exact thread guidance, there is no risk of miscutting.

The invention claimed is:

1. A piston, in particular for an internal combustion engine, having a piston lower part and a piston upper part, an internal annular cooling channel and at least one inlet opening arranged on the piston lower part and at least one outlet opening arranged on the piston lower part, an inflow of coolant into the cooling channel and an outflow of coolant out of the cooling channel taking place via said at least one inlet opening and at least one outlet opening, respectively, wherein the at least one inlet opening or the at least one outlet opening is formed by a rim hole formed integrally with the piston lower part, characterized in that the at least one rim hole has a thread into which at least one tubular element is inserted.

2. The piston as claimed in claim 1, characterized in that the at least one rim hole terminates level with the surface of a cooling channel wall.

3. The piston as claimed in claim 1, characterized in that the at least one rim hole has at least one collar.

4. The piston as claimed in claim 3, characterized in that the at least one collar is formed on that side of the cooling channel wall that faces pin bores.

5. The piston as claimed in claim 3, characterized in that the at least one collar is formed on that side of the cooling channel wall that faces away from pin bores and thus projects into the cooling channel.

6. The piston as claimed in claim 5, characterized in that the at least one tubular element projects into the cooling channel from one of the at least one rim hole or the collar of the at least one rim hole.

7. The piston as claimed in claim 6, characterized in that the at least one tubular element projects from the thread in the direction away from the cooling channel.

8. The piston as claimed in claim 3, characterized in that the at least one tubular element terminates flush with one of the at least one rim hole or with the collar of the at least one rim hole.

9. The piston as claimed in claim 1, characterized in that at least one tubular element projects from the thread in the direction away from the cooling channel.

10. The piston as claimed in claim 9, characterized in that that end of the at least one tubular element that is directed away from the cooling channel is funnel-shaped.

11. A method for regulating the coolant level in a cooling channel of a piston, in particular for internal combustion engines, which has at least one inlet opening and/or outlet opening in the cooling channel, formed by at least one rim hole, characterized in that the coolant level in the cooling channel is set via an adjustable tubular element.

12. The method as claimed in claim 11, characterized in that the rim hole for forming the at least one inlet opening or outlet opening has been produced by friction drilling.

13. The method as claimed in claim 12, characterized in that a thread in the rim hole, which forms the at least one inlet opening or outlet opening, has been created by thread cutting.

14. The method as claimed in claim 13, characterized in that the thread in the rim hole, which forms the at least one inlet opening or outlet opening, has been created by thread forming.

15. The method as claimed in claim 11, characterized in that a thread in the rim hole, which forms the at least one inlet opening or outlet opening , has been created by thread cutting.

16. The method as claimed in claim 15, characterized in that the thread in the rim hole, which forms the at least one inlet opening or outlet opening, has been created by thread forming.

17. The method as claimed in claim 11, characterized in that the cooling level is regulated via the length of engagement of the tubular element in a thread located in the cooling channel.

* * * * *